US005814779A

United States Patent [19]

Verras et al.

[11] Patent Number: 5,814,779

[45] Date of Patent: Sep. 29, 1998

[54] FLUID PRESSURE RESPONSIVE ELECTRIC SWITCH

[75] Inventors: George Verras, Mansfield, Mass.; Daniel Morin, North Providence, R.I.

[73] Assignee: Texas Instruments Incorporated, Dallas, Tex.

[21] Appl. No.: 724,202

[22] Filed: Oct. 1, 1996

[51] Int. Cl.[6] ..... H01H 35/34

[52] U.S. Cl. ..... 200/83 P; 200/81.4

[58] Field of Search ..... 337/343; 200/81.4, 200/81.5, 83 R, 83 S, 83 P, 83 W, 83 Y, 302.1; 91/1; 92/5 R, 98 R, 101; 340/626; 307/118; 73/861.47, 717, 723

[56] References Cited

U.S. PATENT DOCUMENTS

| | | | |
|---|---|---|---|
| 4,498,069 | 2/1985 | Calenda et al. . | |
| 4,581,509 | 4/1986 | Sanford et al. . | |
| 4,747,165 | 5/1988 | Marcoux et al. . | |
| 4,794,214 | 12/1988 | Sanford | 200/83 P |
| 4,948,931 | 8/1990 | Nixon | 200/83 P |

*Primary Examiner*—Gerald P. Tolin
*Attorney, Agent, or Firm*—Russell E. Baumann; Richard L. Donaldson; René E. Grossman

[57] ABSTRACT

A fluid pressure responsive electric switch (100) is shown in which first and second discrete electrical switches are controlled. A first movable support ring (122) mounts first and second snap acting discs (120*a*, 124*a*) on opposite sides thereof, the discs each having the normally concave surface facing the support ring. The first disc receives a force through a pressure to force converter (134) which is transferred through the second disc to a second movable support (126) and a third snap acting disc (128*a*) having a normally concave surface facing a related movable contact arm. When the system pressures exceeds a first minimum level the third disc (128*a*) snaps allowing a motion transfer pin to transfer a force to the movable contact arm (118*a*) of a compressor actuation switch (118) to energize the compressor. When system pressure increases to a second higher level the first disc (120*c*) snaps and transfers motion via a motion transfer pin (120*c*) to the movable arm (116*a*) of a fan actuation switch to energize the fan. If the system pressure increases to a third still higher level, the second disc (124*a*) snaps thereby allowing the spring bias of the movable arm (118*a*) of the compressor actuation switch to separate from the mating stationary contact to thereby de-energize the compressor.

According to a second embodiment the switch (200) includes only the fan actuation and compressor high pressure cut-out functions by eliminating the third disc and by making the second support (130*c*') stationary.

7 Claims, 3 Drawing Sheets

FLUID PRESSURE RESPONSIVE ELECTRIC SWITCH

This invention relates generally to electrical switches and more particularly to switches using spring disc elements which move between oppositely dished, convex and concave configurations and which are actuated upon the occurrence of selected conditions, such as fluid pressure.

BACKGROUND OF INVENTION

Conventional condition responsive switches have a contact arm movable between first and second switch positions prebiased to one switch position. A dished-shaped snap acting disc element movable between oppositely dished, convex and concave configurations is provided for moving the contact arm to the other switch position in response to the occurrence of selected temperature or pressure conditions in a monitored zone thereby performing selected control functions in response to such conditions. An example of a switch of this type is shown and described in U.S. Pat. No. 4,581,509 which issued to the assignee of the present invention.

This type of switch has become widely used, among other applications, in automotive environments such as in air-conditioning refrigeration compressor systems. For example, there is a need in such a system to provide a switch to protect the system from excessive high pressure. Additionally, there is a need to provide a switch to protect the system from loss of freon and lubricant charge and resulting compressor damage. Both switches are typically mounted in the compressor housing and monitor the high pressure side of the system. A dual function switch is shown and described in U.S. Pat. No. 4,757,165, also issued to the assignee of the present invention, which provides protection from excessive pressure as well as from too little pressure. In accordance with the latter patent a normally open electric switch is mounted adjacent first and second vertically aligned discs adapted to move from one dished configuration to an opposite dished configuration upon the occurrence of selected conditions. The first disc is disposed on a first disc seat and has a normally concave surface configuration facing the switch. The first disc has a centrally disposed aperture through which a motion transfer pin extends between a movable contact arm of the electrical switch and the second disc disposed on a second disc seat. The second disc has a normally convex surface configuration facing toward the switch and is mounted on a pressure force converter which is adapted to move the second disc toward a reaction surface on a floating ring disposed intermediate to the two discs. The first disc is adapted to invert its curvature upon being exposed to increasing pressures of a selected first level to actuate the switch and the second disc is adapted to invert its curvature upon being exposed to increasing pressures of a selected, higher level to de-actuate the switch.

Another function dependent upon the pressure level of the high side of the air-conditioning system is the energization of a fan at pressures above a certain level. The function of fan energization and high and low pressure protection are combined in a prior art switch shown in FIG. 1 in which a first disc means 12 comprising a first stack 14 of several discs is mounted on a movable first disc seat member 16 having a centrally disposed opening. A first motion transfer pin 18 extends through the opening from the stack of discs and is adapted to engage a first movable contact arm 20 movable into and out of engagement with a second movable contact arm 21 of a fan energization switch through a second tubular motion transfer pin 22 with the normally concave side of the discs 14 facing the first movable contact arm 20. A second disc means 24 comprising a second stack 26 of discs is mounted on one side 28 of a second movable disc seat member 30 also having a centrally disposed opening through which the first and second motion transfer pins extend. The second motion transfer pin 22 extends between the second stack 26 of discs and is adapted to engage a third movable contact arm 32 of a compressor energization switch with the normally concave side of the discs 26 facing the third movable contact arm. The third movable contact arm 32 is movable into and out of engagement with a fourth movable contact arm 34. A third disc means 36 comprising a single disc 38 is mounted on a third immovable disc seat member 40 in engagement with a side of the second movable disc seat member 30 opposed to the second stack of discs with the normally concave side of the single disc 38 facing the third and fourth contact arms. The second movable disc seat member 30 is provided with a motion transfer portion 42 which is movable into and out of engagement with the fourth movable contact arm 34.

As the system pressure rises to a first level the third disc means 36 snaps by virtue of the force transferred through a diaphragm (not shown), the first disc means 12, first disc seat member 16, second disc means 24 and second disc seat member 30 thereby allowing the motion transfer surface 42 of the second disc seat member to move the fourth movable contact arm 34 into electrical engagement with the third movable contact arm 32 to energize the compressor as indicated by dashed lines 44. Motion transfer member 18 is concomitantly moved downwardly to be closely adjacent to movable arm 20 as noted by dashed line 46. A further increase in system (high side) pressure results in the first disc means 12 snapping causing the first motion transfer member 18 to bias the first movable arm 20 into engagement with the second movable contact arm 21 to thereby energize the fan circuit as noted by dashed lines 48. An increase in system pressure to a third higher level will cause the second disc means 24 to snap so that the second motion transfer member 22 will move the third movable contact arm 32 out of electrical engagement with the fourth movable contact arm 34 to de-energize the compressor as indicated by dashed lines 50.

This latter device, while providing a desirable feature of combining the control of energization of the compressor and the fan in a single device has several limitations. One such limitation relates to the pairs of movable contact arms. The engaging and disengaging of electrical contacts mounted on the respective movable contact arms moving in the same direction to engage and disengage the respective electric circuits results in little or no contact wiping and with a relatively low level of contact force between these electrical contacts which tends to be inconsistent from device to device. Another limitation relates to the means used to provide the required force levels for actuating the switches. That is, in order to achieve the required force levels a plurality of discs are stacked one on top of the other to perform both the fan energization and the high pressure cut-out of the compressor functions. Special precautions must be taken when using stacked discs to prevent cold welding of the discs to one another and to minimize friction between adjacent discs.

SUMMARY OF THE INVENTION

It is an object of the present invention to provide an improved pressure responsive electric switch employing snap acting discs which overcomes the above noted prior art limitations.

Another object of the invention is the provision of such a switch in which contact engagement and disengagement is effected with contact wiping between the surfaces of the mating contacts to break through oxide layers on the surfaces of the contacts. Yet another object of the invention is the provision of such a switch which has a predictable, consistent contact force between mating electrical contacts.

Briefly, in accordance with the invention, a fluid pressure switch has a flexible membrane for interfacing between fluid pressure and a switch mechanism through a movable pressure to force converter. The converter engages a first snap acting disc whose normally concave surface faces a related movable contact arm, the disc mounted on one side of a first movable support member with a second snap acting disc whose normally convex surface faces a related movable contact arm mounted on the opposite side of the first movable support member and in engagement with an amplifier surface on a second movable support member. A third, snap acting disc whose normally concave surface faces a related movable contact arm is disposed on the opposite side of the second movable support member. A first motion transfer pin extends between the first disc and a first movable contact arm of a fan actuation switch. The first motion transfer pin extends through apertures in the first movable support member and the second disc and is slidably received through the bore of a second tubular motion transfer pin. The first movable contact arm moves into and out of engagement with a stationary contact. The second motion transfer pin extends between the second disc and the second movable contact arm of a compressor actuation switch through an aperture in the second movable support. The second movable contact arm moves into and out of electrical engagement with a stationary contact. When system pressure increases to a first minimum level the third disc snaps to a convex configuration facing the movable contact arms allowing the first and second movable supports to move toward the movable contact arms with the second motion transfer member biasing the second movable contact arm into engagement with its mating stationary contact thereby to energize a compressor circuit. When a second higher system pressure level is reached the first disc snaps to a convex configuration facing the movable contact arms and transfers motion through the first motion transfer pin to bias the first movable contact arm into engagement with its mating stationary contact and close the fan energization switch. If the system pressure level reaches a third maximum level the second disc snaps to a concave configuration facing the movable contact arms allowing the second movable support and the second motion transfer pin to move back under the influence of the spring action of the second movable arm to de-energize the compressor actuation switch.

According to a feature of the invention, both movable contact arms move into and out of engagement with stationary contacts thereby providing a wiping action to break through any oxide layers which tend to build up on the contact surfaces. A consistent high contact force is obtained by reason of the force amplifier surfaces on the pressure to force converter and on the second movable support member.

In accordance with an alternative embodiment of the invention, a simplified version of the switch combines the fan energization switch and the high pressure cut-out switch in which the second support is stationary and the third disc is eliminated.

BRIEF DESCRIPTION OF THE DRAWINGS

Other objects, advantages and details of the pressure responsive switch of this invention appear in the following detailed description of the preferred embodiments of the invention, the detailed description referring to the drawings in which.

DETAILED DESCRIPTION OF PREFERRED EMBODIMENTS

Figure 1:
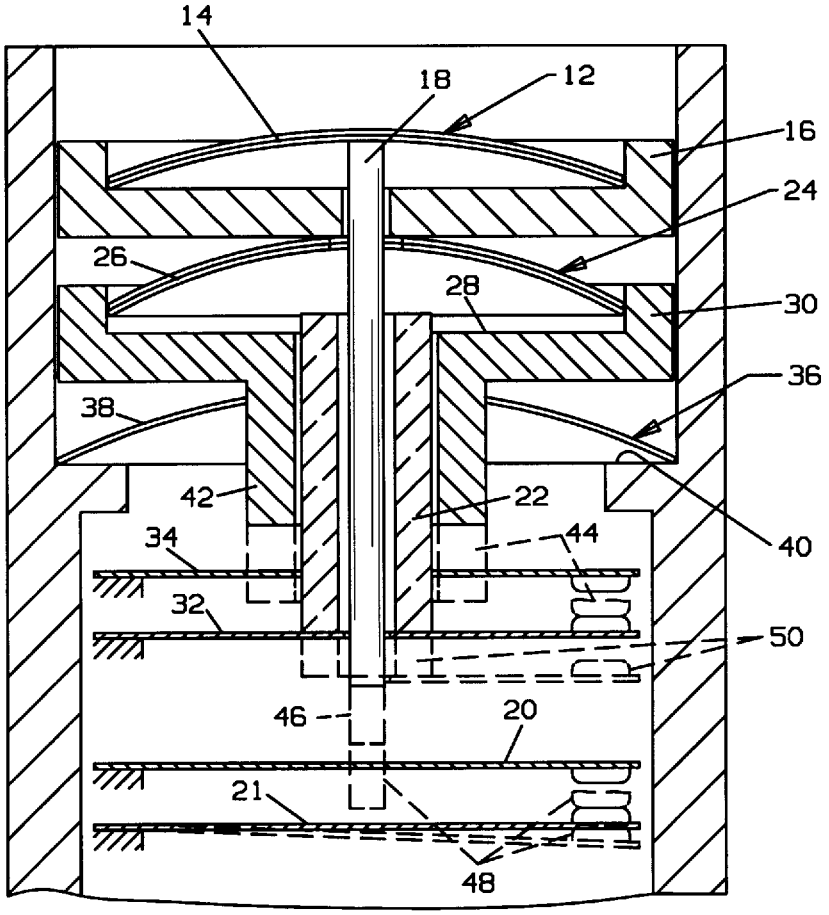
PRIOR ART FIG. 1
FIG. 1 is a cross sectional view, partly schematic, of a portion of a prior art pressure responsive electric switch controlling the energization of two discrete electrical circuits.
Figure 2:
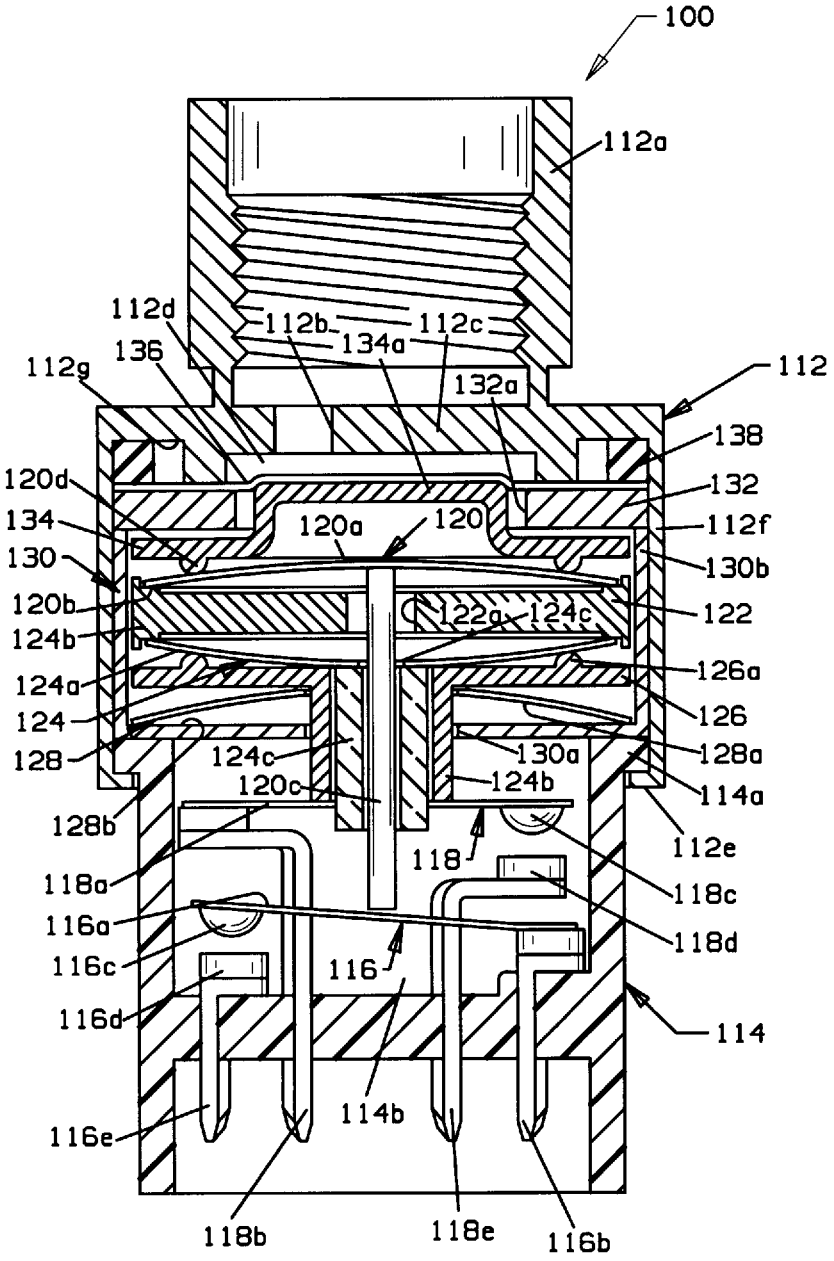
FIG. 2 is a cross sectional view of a pressure responsive electric switch made in accordance with a first embodiment of the invention.

With reference to FIG. 2, a fluid pressure switch 100 made in accordance with a first embodiment of the invention comprises a housing member 112 having a fluid coupling portion 112*a* for attachment to a fluid pressure source to be monitored. Housing member 112 has an orifice 112*b* formed in a wall 112*c* allowing ingress of fluid to a pressure chamber 112*d* in a conventional manner. Distal end 112*e* of a sidewall 112*f* of housing member 112 is attached to a radially extending flange 114*a* of a base 114 as by crimping. Base 114 defines a switch chamber 114*b* housing first and second electrical switches 116, 118 respectively. First switch 116 comprises a first movable contact arm 116*a* cantilever mounted on terminal 116*b* and mounting a movable contact 116*c* adapted for movement into and out of engagement with a stationary contact 116*d* mounted on terminal 116*e*. Second switch 118 comprises a second movable contact arm 118*a* cantilever mounted on terminal 118*b* and mounting a movable contact 118*c* adapted for movement into and out of engagement with a stationary contact 118*d* mounted on terminal 118*e*.

A first disc means 120 comprises a snap acting disc 120*a* mounted on disc seat 120*b* on a first side of a first movable disc support 122. Snap acting disc 120*a* is movable between oppositely dished concave, convex configurations having a normally concave surface facing (as shown) an associated movable contact arm 116*a* of first electrical switch 116. A first motion transfer pin 120*c* formed of suitable material, such as ceramic, extends from disc 120*a* to movable contact arm 116a through an aperture 122*a* of movable disc support 122 and through openings in a second disc means 124 and movable switch arm 118*a* to be discussed. Second disc means 124 comprises a snap acting disc 124*a* mounted on disc seat 124*b* on a second side of first movable disc support 122 opposed to the first side mounting disc 120*a*. Snap acting disc 124*a* is movable between oppositely dished concave, convex configurations having a normally convex surface facing (as shown) an associated movable contact arm 118*a*. Disc 124*a* is formed with a centrally disposed aperture 124*c* which receives therethrough motion transfer pin 120*c*. A second movable disc support 126 is disposed on the side of disc 124*a* removed from first disc support 122. Second movable disc support 126 has an annular reaction ring 126*a* adapted to engage disc 124*a* and a centrally disposed opening with a motion transfer pin sleeve 124*b* extending downwardly therefrom away from disc 124*a*. A second motion transfer pin 124*c*, in the form of a tube and formed of suitable material, such as ceramic, is slidably disposed within sleeve 124*b* and extends between disc 124*a* and second movable contact arm 118*a*. Motion transfer pin 120*c* is slidably disposed within tubular motion transfer pin 124*c* with each pin movable independently of one another.

A third disc means 128 comprises a snap acting disc 128*a* mounted on a fixed disc seat 128*b*. Snap acting disc 128*a* is movable between oppositely dished concave, convex configurations having a normally concave surface (as shown) facing an associated movable contact arm 118*a*. Fixed disc seat 128*b* is formed in a bottom wall of a cup-shaped fixed support member 130 having a side wall 130*b* and an aperture 130*a* in the bottom wall for slidably receiving sleeve 124*b*. An annular washer 132 is disposed on the distal free end of sidewall 130*b*. Cup-shaped support member 130 and washer 132 form a fixed, rigid enclosure receiving the movable supports and discs. A pressure to force converter 134 has a hub portion defining a pressure receiving surface 134*a* which is received in an opening 132*a* of washer 132. A force applying ring 120*d* is formed on a side of converter 134 opposite to force applying surface 134*a* and is adapted to place a force on first disc means 120 corresponding to the fluid pressure of fluid received in pressure chamber 112*d*. A flexible membrane 136 serves as an interface between the fluid medium of the fluid pressure and the disc means and switches and is received on washer 132 and pressure receiving surface 134*a*. A suitable elastomeric gasket 138 is disposed between diaphragm 136 on washer 132 and an overlying surface 112*g* of housing 112.

As the pressure of the system rises, a force is exerted on converter 134 through diaphragm 136. A preselected increase in pressure will cause disc 128*a* to snap allowing converter 134 and movable supports 122, 126 to move along with motion transfer pin 124*c* to close switch 118, i.e., movable contact 118*c* moves into engagement with stationary contact 118*d* with contact 118*c* wiping on stationary contact 118*d* as the movable arm 118*a* is flexed. Switch 118 is adapted for connection to the compressor of an automotive air conditioning system. Although motion transfer pin 120*c* also moves toward movable arm 116*a* it does not yet transfer motion to movable arm 116*a*. As the fluid pressure continues to rise, disc 120*a* snaps with its motion transferred to movable contact arm 116*a* to close switch 116 with movable contact 116*c* wiping on stationary contact 116*d* as movable arm 116*a* flexes. Switch 116 is adapted for connection to a fan circuit. Continued increase in pressure to a preselected high pressure level will cause disc 124*a* to snap thereby allowing movable contact 118*c* to move out of engagement with stationary contact 118*d* due to the normal open contacts bias of movable contact arm 118*a* which no longer receives an opposite force from motion transfer pin 124*c*. This results in de-energizing the compressor.

When the fluid pressure falls the contacts will operate in the reverse sequence.

Figure 3:
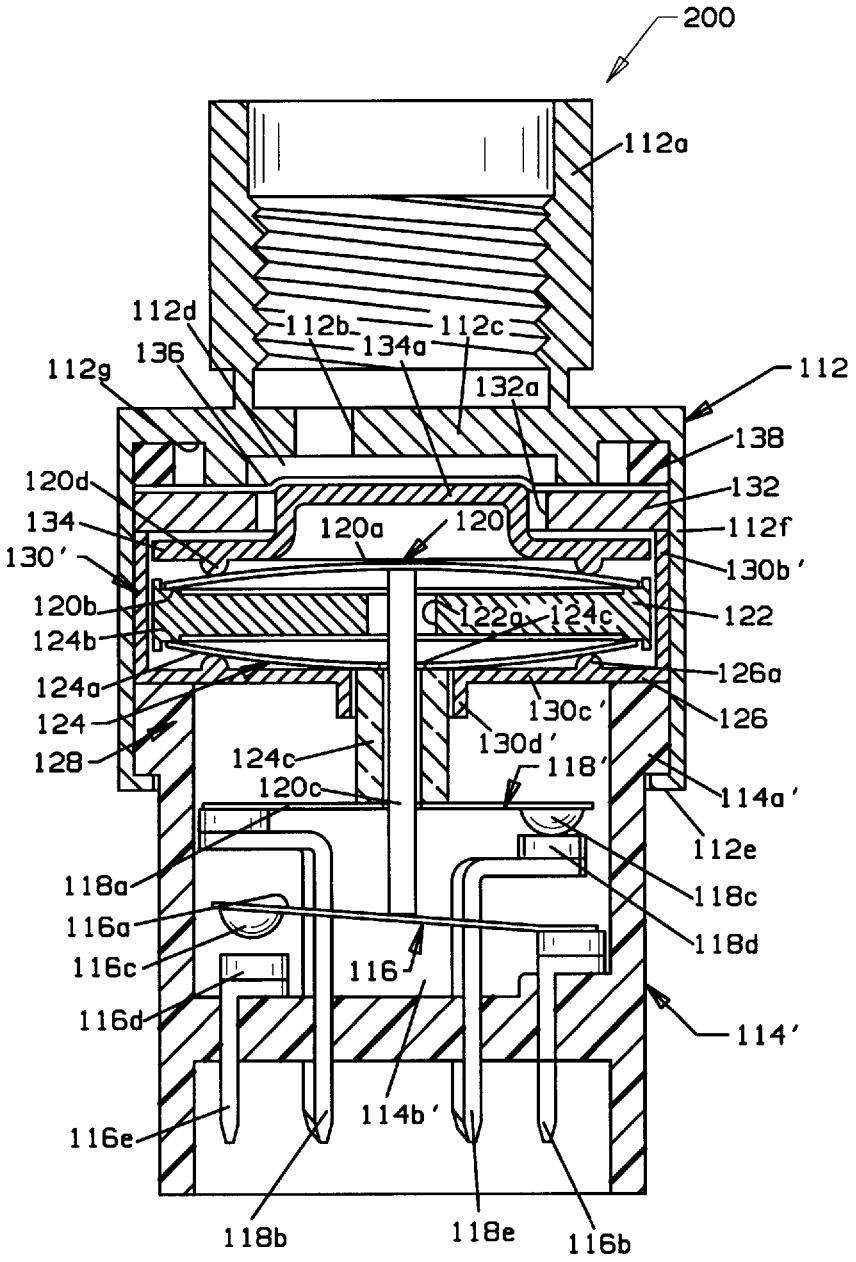
FIG. 3 is a cross sectional view of a pressure responsive electric switch made in accordance with a second embodiment of the invention.

A second embodiment of the invention is shown in FIG. 3. Switch 200 of the second embodiment operates two separate electrical circuits as does switch 100 of the first embodiment; however, in the second embodiment the second switch 118' is normally closed in contradistinction with the normally open second switch 118 of FIG. 2. Switch 200 comprises first and second disc means 120, 124 respectively, as in the previous embodiment; however, annular reaction ring 126*a* is formed on bottom wall 130*c*' which is stationary. Sleeve 130*d*' slidably receives the second tubular motion transfer pin 124*c*. Housing member 112 is attached to base 114' by bending distal free end 112*e* of sidewall 112*f* over flange 114*a*' of the base in the same manner as in the FIG. 2 embodiment. The other elements of switch 200 are the same as in the FIG. 2 embodiment and need not be repeated.

As mentioned above in the FIG. 3 embodiment, the second switch 118' is normally closed. A force is exerted on converter 134 through diaphragm 136 in the same manner as in the FIG. 2 embodiment and as pressure rises to the first preselected level the force is transferred to the discs causing disc 120*a* to snap thereby actuating the first switch 116 causing movable contact 116*c* to engage stationary contact 116*d*. When the pressure increases to the preselected upper level disc 124*a* snaps to de-energized switch 118' causing movable contact 118*c* to move out of engagement with stationary contact 118*d*. As pressure decreases the switches will operate in the reverse sequence.

As used in an automotive air conditioning system, the compressor circuit of the air conditioner is normally closed and the fan circuit is normally open. Thus the compressor is normally engaged when the air conditioner is turned on. The fan is cycled on and off by means of switch 116 independently of switch 118. Continued increase of pressure to a preselected level will cause disc 124*a* to snap and thereby de-energize the A/C system.

The improved switch of the invention eliminates the need of a third motion transfer pin relied on in the prior art and the use of force applying surfaces 120*d* and 126*a* provide the required force amplification to permit use of a single disc in each of the disc means to provide predictable, high force levels which provide the wiping motion of movable contacts 118*c*, 116*c* on respective stationary contacts 118*d*, 116*d* thereby providing improved operation by breaking through contamination, e.g., oxide layers, which tend to form on the contact surfaces.

Thus by means of the invention, first and second discrete electrical circuits are controlled through first and second switches having high contact forces to obviate potential problems caused by vibration normally occasioned in automotive environments and having desired contact wiping to break through contamination, such as oxide layers on the surface of the contacts. A pressure to force converter and snap acting disc assemblies are disposed between a stationary support and a stationary annular member with a surface of the pressure to force converter extending through the opening in the annular member. A flexible diaphragm and gasket are clamped over the annular member to provide a tightly controllable pressure sensing unit.

It should be understood that although particular embodiments of the described multiple circuit, pressure responsive switch of the invention has been described by way of illustrating the invention, the invention includes all modifications and equivalents of the disclosed embodiments falling within the scope of the appended claims.

What is claimed:

1. A pressure responsive electric switch for controlling separate first and second electrical circuits in response to selected pressure levels comprising:

a housing having an upper end portion and a lower end portion, first and second sets of electrical contacts mounted in the lower end portion of the housing, each set having a stationary and a movable contact member, each movable contact member movable into and out of engagement with the respective stationary contact member, the second movable contact member having an aperture therethrough, a fluid receiving port formed in the upper end portion of the housing, a movable mounted pressure to force converter having a pressure receiving surface on one side of the converter and a force transfer surface on an opposite side of the converter, a flexible diaphragm disposed between the port and the pressure receiving surface of the converter, a support ring having an outer peripheral portion with first, upper and second, lower, disc seats formed on opposite sides thereof, the ring having a centrally located opening therethrough, a first snap acting disc movable between oppositely dished configurations received on the first, upper, disc seat of the ring and being in engagement with the force transfer surface of the converter, a second snap acting disc movable between oppositely dished configurations received on the second, lower, disc seat of the ring, the second snap acting disc having a centrally disposed aperture therethrough, a support member mounted in the housing having a centrally disposed opening with a motion transfer pin sleeve extending therefrom, a reaction surface formed on the support member in engagement with the second snap acting disc, and first and second motion transfer pins, the second motion transfer pin having a bore therethrough and slidably received in the motion transfer pin sleeve of the support member and extending between the second snap acting disc and the second movable contact member, and the first motion transfer pin extending from the first snap acting disc through the opening of the ring and the apertures of the second snap acting disc and the second movable contact member to the first movable contact member.

2. A pressure responsive electric switch according to claim 1 in which the support member is fixedly mounted in the housing.

3. A pressure responsive electric switch according to claim 1 further comprising a third snap acting disc, the third snap acting disc having a centrally disposed aperture therethrough, and a third disc seat formed in the housing, the support member being movable mounted and having a lower surface, the third snap acting disc mounted on the third disc seat in engagement with the lower surface of the support member.

4. A pressure responsive electric switch according to claim 1 in which the oppositely dished configurations are convex and concave facing an associated movable contact member respectively, and the first snap acting disc has a normally concave configuration facing the first movable contact member and the second snap acting disc has a normally convex configuration facing the second movable contact member.

5. A pressure responsive electric switch according to claim 4 in which the first set of electric contacts is normally open and the second set of electric contacts is normally closed.

6. A pressure responsive electric switch according to claim 3 in which the third snap acting disc has a normally convex configuration facing the second movable contact member.

7. A pressure responsive electric switch according to claim 6 in which the first and second sets of electric contacts are normally open.

* * * * *